United States Patent [19]

Quantz

[11] Patent Number: 5,007,261

[45] Date of Patent: Apr. 16, 1991

[54] ELECTRICALLY ACTUATED LOCK MECHANISM WITH ELECTRICAL FAILURE PROTECTION

[76] Inventor: Norman G. Quantz, 2584 Norway Lake Rd., Lapeer, Mich. 48446

[21] Appl. No.: 383,198

[22] Filed: Jul. 20, 1989

[51] Int. Cl.[5] ..... E05B 60/19

[52] U.S. Cl. ..... 70/240; 70/277; 292/201; 292/216

[58] Field of Search ..... 70/240, 241, 277, 279; 292/DIG. 43, DIG. 42, 201, 216

[56] References Cited

U.S. PATENT DOCUMENTS

| | | | |
|---|---|---|---|
| 2,896,990 | 7/1959 | Garvey et al. | 292/201 X |
| 3,016,968 | 1/1962 | Lenz et al. | 292/201 X |
| 3,421,785 | 1/1969 | Slattery | 292/216 |
| 3,504,511 | 4/1970 | Allen | 70/279 X |
| 3,565,477 | 2/1971 | Gionet et al. | 70/240 X |
| 3,917,330 | 11/1975 | Quantz | 292/216 |
| 4,334,704 | 6/1982 | Yamada | 292/216 |
| 4,468,941 | 9/1984 | Bascou | 70/241 |
| 4,569,544 | 2/1986 | Escavarage | 292/201 X |
| 4,652,027 | 3/1987 | Quantz | 70/241 X |
| 4,667,990 | 5/1987 | Quantz | 70/241 X |

*Primary Examiner*—Gary L. Smith
*Assistant Examiner*—Suzanne L. Dino
*Attorney, Agent, or Firm*—Remy J. VanOphem

[57] ABSTRACT

An electrically actuated rear deck lock mechanism which may be locked or unlocked in a conventional manner. The lock mechanism latches the deck lid with a latch member engaging a lock bar after closure of the deck lid. An electric actuator moves the latch to a locked position. Once in the locked position, the electrical actuator mechanism is free of the mechanical forces applied to the latch member such that any forces experienced during normal operation of the vehicle are absorbed through the mechanical interaction of the latch with the lock bar without undue effect on the electrical actuator. The latch member can also be manually moved to a locked position without interfering with the electrical locking position of the mechanism. A bypass cam and a release member are provided which permit the rear deck locking mechanism to be manually locked and unlocked in the event of a power failure or a failure of the electric actuator.

20 Claims, 5 Drawing Sheets

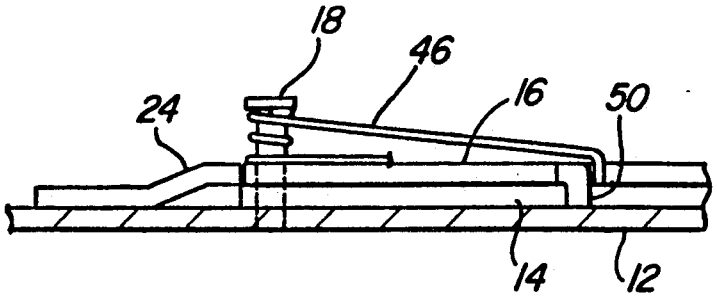
Fig-13
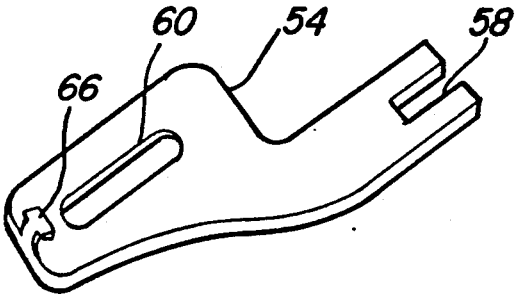
Fig-4
Fig-15
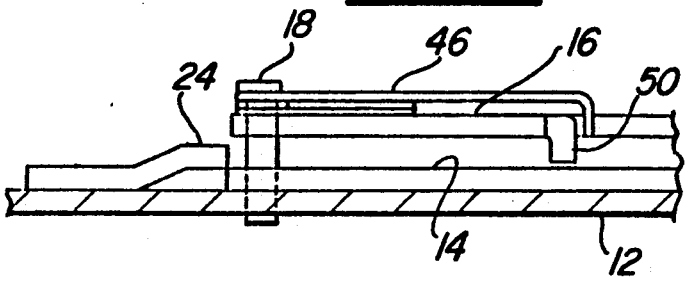
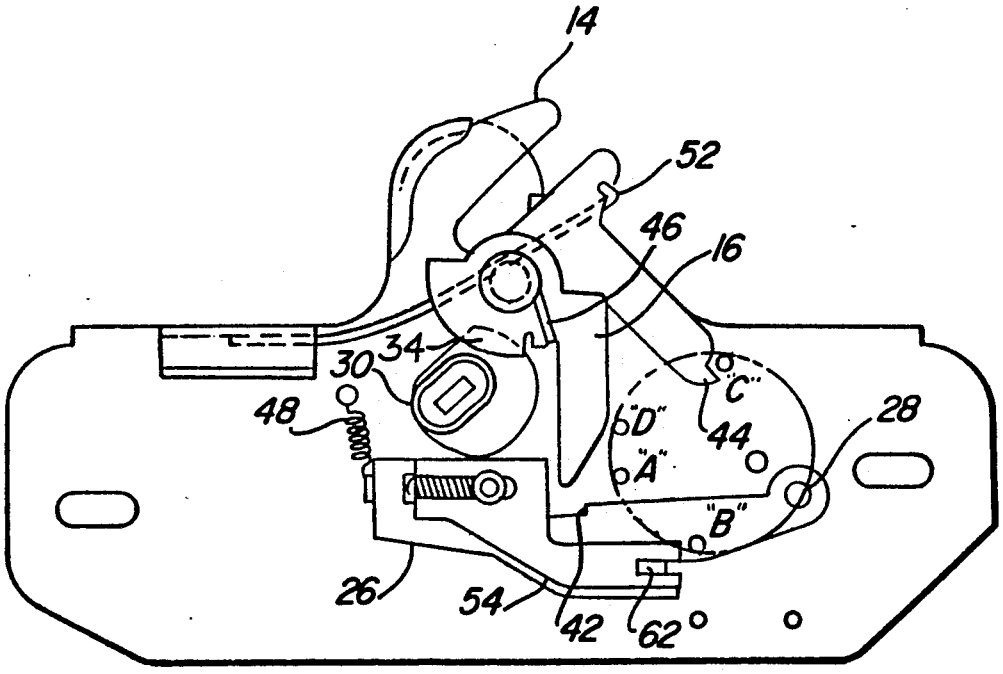
Fig-14

ELECTRICALLY ACTUATED LOCK MECHANISM WITH ELECTRICAL FAILURE PROTECTION

BACKGROUND OF THE INVENTION

1. Field of the Invention

The invention is related to electrical lock mechanisms and, in particular, to an electrically actuated lock mechanism for the rear deck lid of an automotive vehicle having electrical failure protection.

2. Description of the Prior Art

Lock mechanisms for the rear deck lid of automotive vehicles are well known in the art. In general, most of the rear deck lid locking mechanisms are purely mechanical and incorporate a latch member entrapping a mating member, such as a lock bar. The locking mechanism may be attached to the rear deck lid and the mating lock bar attached to a structural element of the vehicle below the lower extremity of the rear deck lid opening, or the locking mechanism may be attached to a structural member of the vehicle and the lock bar attached to the rear deck lid. Normally, the mechanical locking mechanisms are locked by forcefully closing the rear deck lid causing the lock bar to engage the latch member and displace it to a locked position. The latch member is mechanically released from the locked position by the rotary motion of a key actuated lock.

In recent years, rear deck lid lock mechanisms have been developed which permit the lock mechanism to be electrically unlatched from inside the vehicle's passenger compartment, as well as manually unlatched by means of the key lock. Typical electrically released rear deck lid lock mechanisms have been disclosed by Quantz in U.S. Pat. Nos. 3,917,330, 4,652,027 and 4,667,990, and by Allen in U.S. Pat. No. 3,504,511. Additionally, power locking mechanisms have been incorporated into the rear deck locking mechanisms to displace the latch member to its locked position such as taught by Peters, in U.S. Pat. Nos. 3,580,623 and 3,596,484, in which a hydraulic mechanism displaces the latch member to the locked position when the rear deck lid is closed. Alternatively, Bellot et al, U.S. Pat. No. 4,395,064, discloses a rear deck lid having an electric motor connected to a lock member and a latch member by a pair of lost motion links. De Claire et al, in U.S. Pat. No. 3,332,713, disclose an electrically driven latch closure having motor driven rack engaging a toothed sector of the latch member to rotate the latch member between its open and latched position. Oishei, U.S. Pat. No. 3,113,447, and Lentz et al, U.S. Pat. No. 3,016,968, disclose a pneumatically operated latch closure mechanism. Garvey et al, in U.S. Pat. No. 2,896,990, disclose a rear deck lid closure mechanism having an electrically driven jack screw for lowering the rear deck lid to its closed position after the latch mechanism has engaged the lock bar. The problem with most of these deck lid power mechanisms, and in particular the electrically actuated rear deck lid locking mechanism taught by Quantz in U.S. Pat. No. 4,667,990, is that the deck lid cannot be locked when the electrical actuator fails in a release position.

The invention is an improved rear deck lid lock mechanism of the type disclosed by Quantz in U.S. Pat. No. 4,667,990 which may be unlocked with a conventional key lock or by an electrical actuator remotely actuated from inside the vehicle's passenger compartment. The lock mechanism disclosed by Quantz may be latched by forceably closing the rear deck lid, causing the latch member to move to its locked position, or by lowering the deck lid with a force only sufficient to displace the latch member towards its locked position. The displacement of the latch member will activate an electrical actuator and thereafter the latch member will be electrically driven to its locked position. The improved rear deck lid lock mechanism also includes a bypass mechanism which allows the rear deck lid to be locked under all types of failure of the electrical actuator.

SUMMARY OF THE INVENTION

The invention is an electrically actuated rear deck lid lock mechanism having a support frame, a lock member pivotally attached to the support frame, and a latch member pivotably connected to the support frame which is displaceable between an open and locked position. The lock member has a lock dog and the latch member has a dog catch which engages the lock dog to lock the latch member in the locked position. The latch member further has a catch slot which receives a lock bar in its open position and entraps the lock bar in the locked position. First resilient means produce a force which biases the latch member towards the open position and a second resilient means produces a force which biases the lock member to engage the lock member's lock dog with the latch member's dog catch.

A release member is slidably attached to the lock member and is laterally displaceable by a bypass cam when the deck lid is manually closed. An electrical actuator is provided for pivotably displacing the latch member against the force of the first spring to a locked position engaging the dog catch with the lock dog and for pivotably displacing the lock member to disengage the lock dog from the dog catch. The electrical actuator has an electric motor which rotates a cam gear. The cam gear has a predetermined cam surface which actuates an electrical switch controlling the operation of the electric motor. The cam gear also has at least one stud which engages the latch member with the rotation of the cam gear to pivot it to the locked position during a first rotational interval and engages the release member during a second rotational interval to pivot the lock member, disengaging the dog catch from the lock dog. The disengagement of the dog catch from the lock dog releases the latch member from the lock member. The electrical switch is responsive to the displacement of the latch member from its open position towards its closed position to provide electrical power to the electric motor and responsive to the contour of the cam surface to terminate the electrical power to the electric motor.

One object of the invention is to provide a lock mechanism which may be mechanically or electrically locked or unlocked.

Another object of the invention is to provide a lock mechanism in which the electrical locking mechanism does not interfere with the mechanical locking of the lock mechanism.

A further object of the invention is to provide a lock mechanism in which the electrical locking mechanism is free of all the mechanical forces applied to the latch member when the latch member is in its locked position.

Still another object of the invention is to provide the capability to manually lock and unlock the lock mechanism in the event of any electrical failure.

These and other objects of the invention will become more apparent from reading the specification in conjunction with the drawings appended hereto.

BRIEF DESCRIPTION OF THE DRAWINGS

FIG. 4 is a perspective view of the release plate;

FIG. 13 is a partial cross-sectional view showing the bypass cam engaged with the latch member;

FIG. 14 is a plan view of the locking member with the latch member disengaged from the bypass cam;

FIG. 15 is a partial side view showing the position of the bypass cam upon rotation of the key actuated cam;

DETAILED DESCRIPTION OF THE PREFERRED EMBODIMENT

Figure 1:
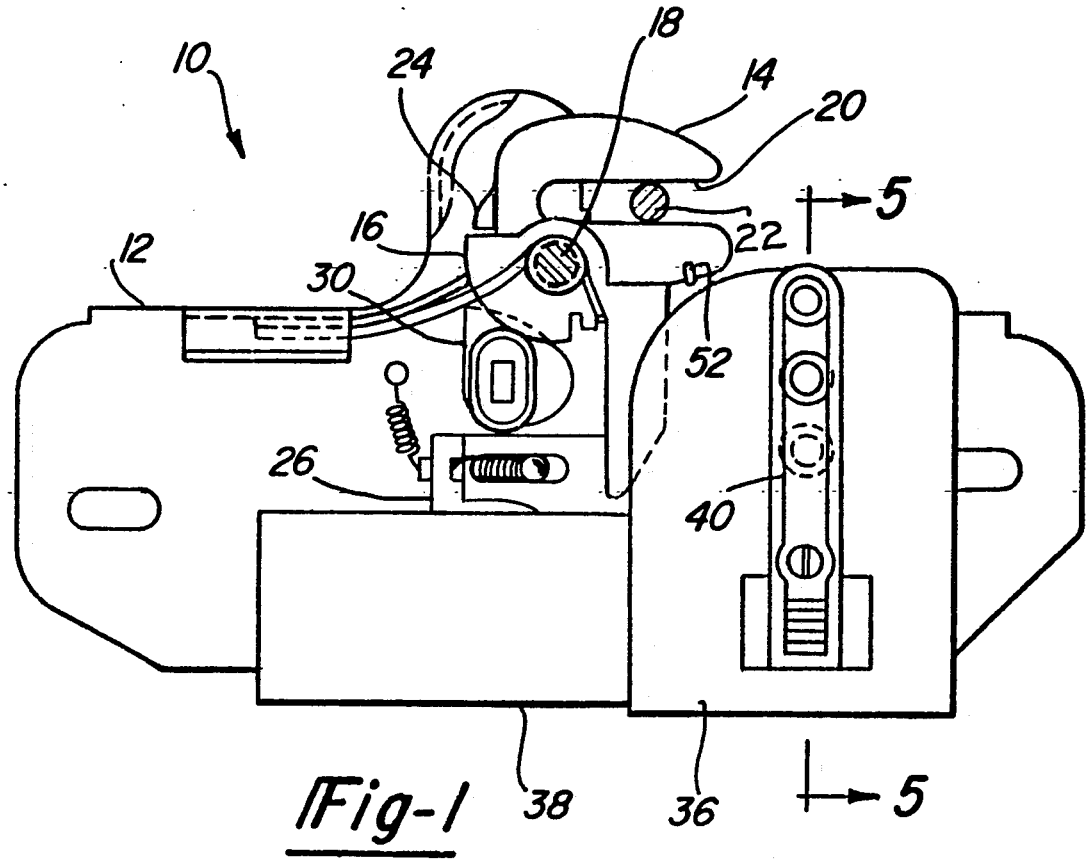
FIG. 1 is a plan view of the rear deck lid lock mechanism in the locked position.

The improved electrically actuated rear deck lock mechanism, generally identified by reference numeral 10, is shown in FIG. 1. The electrically actuated rear deck lock mechanism is structurally very similar to the electrically actuated rear deck lock mechanism disclosed in my prior U.S. Pat. No. 4,667,990 issued Mar. 24, 1987. Referring to FIG. 1, the lock mechanism 10 has a support bracket 12 and includes a latch member 14 and a bypass cam 16. The latch member 14 and bypass cam 16 are pivotally connected to the support bracket 12 by means of a first pivot pin 18. The latch member 14 has a laterally offset catch slot 20 which captivates vehicle lock bar 22 and a raised dog 24 which engages an edge of the bypass cam 16.

Figure 2:
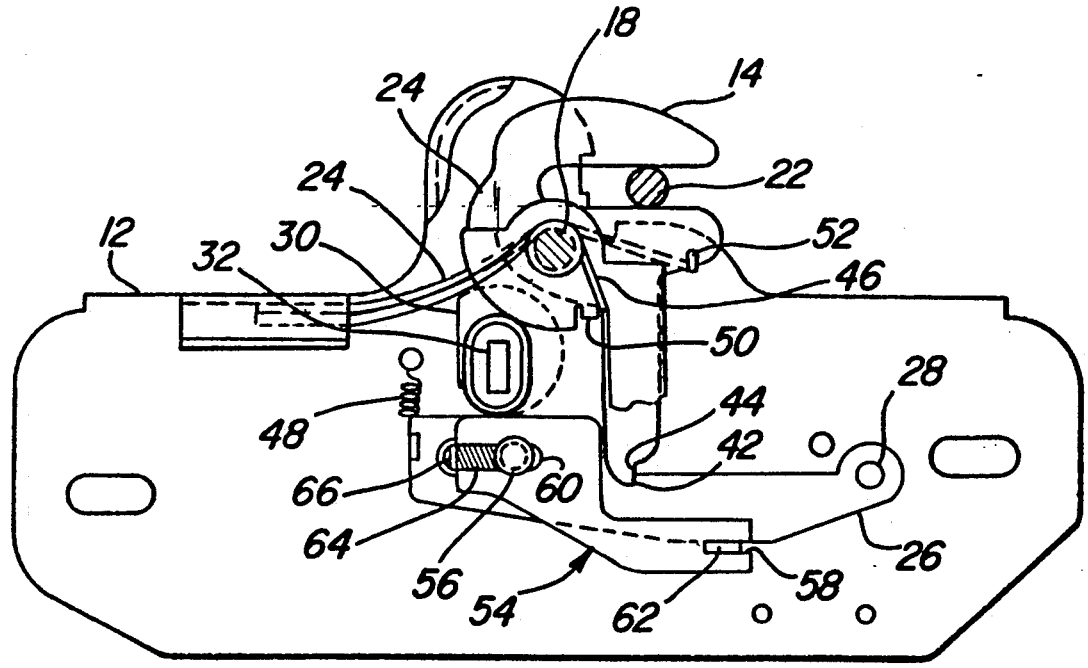
FIG. 2 is a plan view of the rear deck lock mechanism in the locked state in which the electrical lock actuator is removed.

A lock member 26 is pivotally connected to the support bracket 12 by a second pivot pin 28, as shown in FIG. 2, and locks the latch member 14 in its locked position as shall be described hereinafter. The end of the lock member 26 opposite the second pivot pin 28 engages the surface of a key actuated cam 30 which is rotatably attached to the support bracket 12, as more clearly shown in FIG. 2. The cam 30 has a slot 32 for receiving the extension bar of a manually operated lock mechanism (not shown), such as is normally provided for manually unlocking the rear deck lid lock mechanism. The key actuated cam 30 also has a ramp surface 34 which lifts the bypass cam 16 disengaging it from the latch member's raised dog 24, as shall be explained hereinafter. An electrical lock actuator 36, which has an electric motor 38 and a cam actuated single pole double throw switch mechanism 40 is provided. The electrical lock actuator 36 displaces the latch member 14 to its locked position when the rear deck lid is closed and will unlock the latch member in response to an electrical unlock signal.

Figure 3:
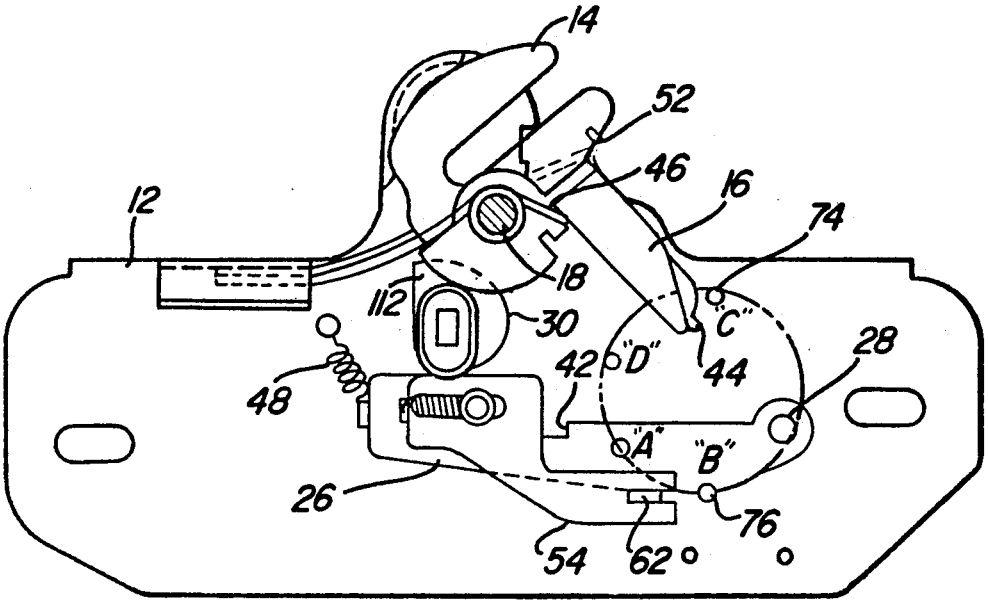
FIG. 3 is a plan view of the rear deck lock mechanism in the unlocked state in which the electrical lock actuator is removed.

In FIGS. 2 and 3, the electrical lock actuator 36 is removed to more clearly show the details of the latch member 14, bypass cam 16, and lock member 26. Referring to FIGS. 2 and 3, the lock member 26 has a dog 42 provided at an intermediate location along its lateral length which is engaged by a dog catch 44 provided at the extremity of the latch member 14. A first coil spring 46, circumscribing the first pivot pin 18, biases the bypass cam 16 to rotate it in a counterclockwise direction about the first pivot pin 18. A second coil spring 48 biases the lock member 26 against the key actuated cam 30. In the locked position of the lock mechanism, the dog 42 engages the dog catch 44 as shown in FIG. 2. The bypass cam 16 has a tab 50 which engages the mating edge of the latch member 14 so that the latch member 14 rotates with the bypass cam 16 in the counterclockwise direction. A third spring 52 independently biases the latch member 14 to rotate in a counterclockwise direction towards the unlocked position.

Unlatching of the dog catch 44 from the dog 42 may be accomplished mechanically by the manual rotation of the key actuated cam 30 by a key inserted in the rear deck lid lock, or electrically, as shall be explained hereinafter.

A release member or plate 54 is slidably connected to the lock member 26 by means of a spring post 56 and a tab slot 58. The spring post 56 is attached to the lock member 26 through a guide slot 60 provided through the release plate 54 as more clearly shown in FIG. 4. The spring post 56 has a head which holds the release member 54 against the lock member 26. The tab slot 58 straddles a guide tab 62 projecting outward from the face of the lock member 26. The tab slot 58 and guide slot 60 permit the release member 54 to be longitudinally displaced along the surface of the lock member 26. A fourth coil spring 64 is connected between a spring tab 66 provided at the end of the release member 54 and the spring post 56. The fourth coil spring 64 biases the release member 54 towards the right, as shown in FIGS. 2 and 3, so that the guide tab 62 is at the left end of the tab slot 58.

Figure 5:
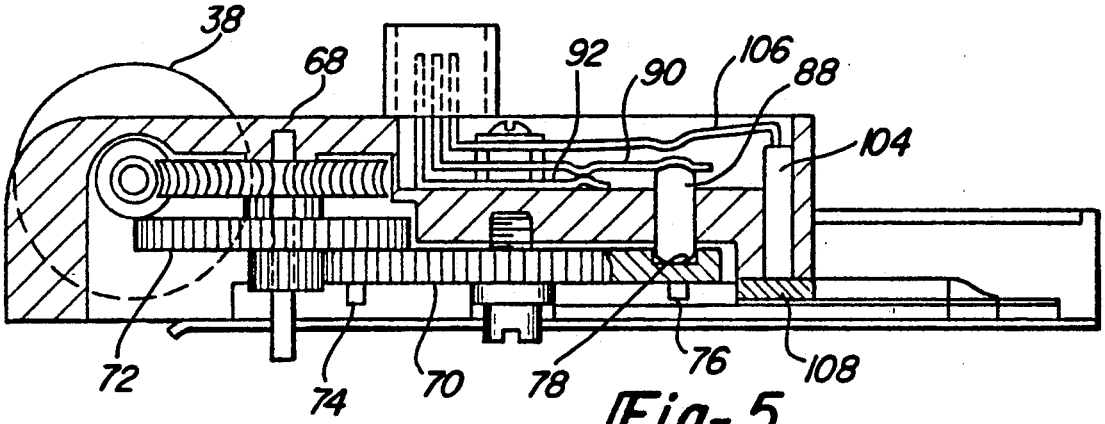
FIG. 5 is a cross-sectional side view of the electrical lock actuator taken through line 5—5 of FIG. 1.

The details of the electrical lock actuator 36 are shown in FIG. 5. Referring now to FIG. 5, the electrical lock actuator 36 has a housing 68 which is attached to the support bracket 12 by a plurality of screws (not shown). Attached to the housing 68 is the fractional horsepower electrical motor 38 which drives a cam gear 70 through a gear train 72.

A pair of diametrically opposed studs 74 and 76 protrude from the surface of the cam gear 70 which faces the support bracket 12 and are operative during a first rotational interval of the cam gear to engage the edge of the bypass cam 16 and return the latch member 14 to its latched position, as shown in FIG. 2, and during a second rotational interval to engage the end of the release member 54 to pivot the lock member and release the latch member's dog catch 44 from the dog 42. The two diametrically opposed studs 74 and 76 are provided so that the cam gear needs to rotate only through a half of a revolution for each complete operational cycle.

Figure 6:
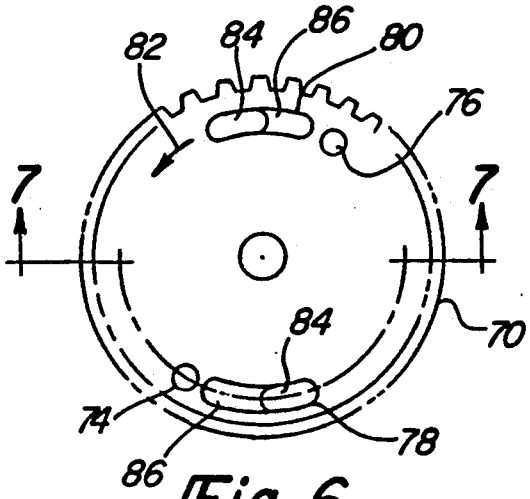
FIG. 6 is a plan view of the cam gear.
Figure 7:
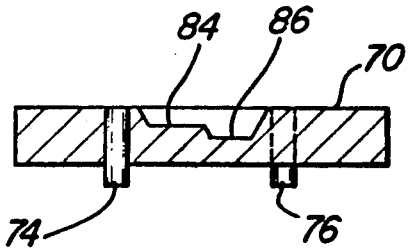
FIG. 7 is a cross-sectional side view of the cam gear taken along line 7—7 of FIG. 6.

As shown in FIGS. 6 and 7, the cam gear 70 has a pair of diametrically opposed arcuate cam grooves 78 and 80 provided in its surface opposite the support bracket 12 immediately preceding each of the studs 74 and 76 in the direction of rotation indicated by arrow 82. As shown in greater detail in FIG. 7, both of the cam grooves 78 and 80 are bi-level such that leading sections 84 of the cam grooves are deeper than trailing sections 86. The bi-level cam grooves 78 and 80 cooperate with the switch mechanism 40 embodied in the housing 68 to lock and release the latch member 14.

Figure 8:
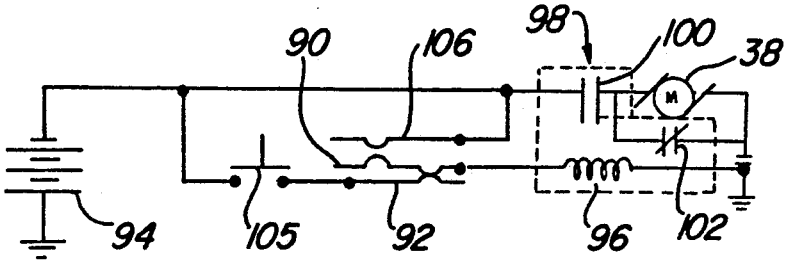
FIG. 8 is a circuit diagram of the electrical lock actuator.
Figure 9:
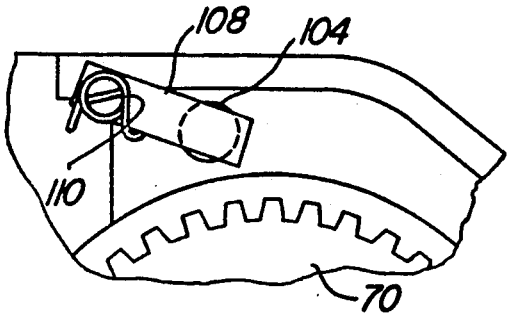
FIG. 9 is a partial cross-sectional view showing the details of the post lock.

In FIG. 5, the electrical lock actuator is shown with the lock mechanism in its locked state with the stud 74 in the position "A" as illustrated in FIG. 3. In this position, a cam follower 88 is in the leading section 84 of the cam groove 78 or 80, and a center spring contact 90 is in electrical contact with a lower spring contact 92. The center spring contact 90 is connected to a coil 96 of a relay switch 98 as shown in FIG. 8. The relay switch 98 has a normally open contact 100 connected to the motor 38, and a normally closed contact 102 connected in parallel with the motor 38. The lower spring contact 92 is connected to a source of electrical power 94 through an unlock switch 105. The center spring contact 90 produces a force on the cam follower 88 causing it to follow the contour of the bi-level cam grooves 78 and 80. A post 104, which is slidably received in an aperture in the housing 68, is attached at one end to an upper spring contact 106. In the locked state, the post 104 is held in an elevated position by a post lock such as a post bar 108 biased by a spring 110 as illustrated in FIG. 9. The post bar 108 holds the post 104 in the highest elevated position when the lock mechanism is in its locked state. In the elevated position of the post 104, the upper spring contact 106 is disengaged from the center spring contact 90. The post bar 108 is displaced from under the post 104 by the bypass cam 16 when the lock mechanism is unlatched, permitting the post 104 to descend to an intermediate level. At the intermediate level the post 104 prevents the post bar 108 from assuming a position under the post 104 until the post 104 is again raised to its elevated position by the cam follower 88 acting on the upper spring contact 106. The upper spring contact 106 produces a force on the post 104, urging it downward to its lowest permitted level.

Referring now to FIG. 8, when the unlock switch is depressed, the relay switch 98 is energized through the electrical contact between the spring contacts 90 and 92 which causes the normally open contact 100 to close and the normally closed contact 102 to open. The closing of the normally open contact 100 energizes the electric motor 38 to rotate the cam gear to displace the stud 74 from position "A" to position "B", as shown in FIG. 3. During this rotational interval the stud 74 engages the end of the release member 54 pivoting the lock member 26 away from the latch member 14. The pivoting of the lock member 26 disengages the dog 42 from the dog catch 44, and releases the latch member 14. The latch member 14 and bypass cam 16, biased by the first and third coil springs 46 and 52, respectively will then rotate to the open position as shown in FIG. 3.

Figure 10:
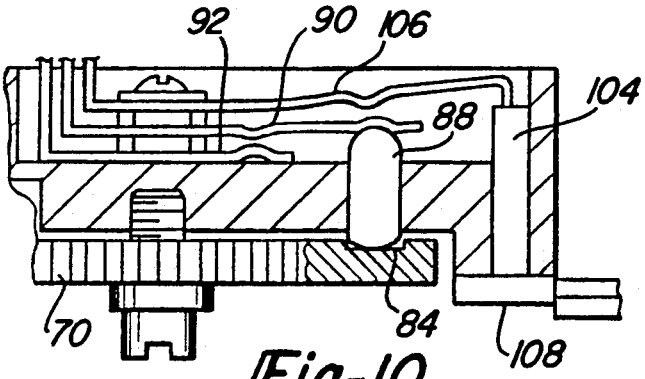
FIGS. 10 through 12 are partial cross-sectional views showing the state of the switch mechanism 40 during sequential stages of operation.

When the stud 74 reaches position "B", the cam follower 88 rises up in the leading section 84 of the arcuate bi-level groove 78 or 80, which displaces the center contact spring 90 upward a distance sufficient to break the electrical contact between the center spring contact 90 and the lower spring contact 92 but not high enough to make electrical contact between the center spring contact 90 and the upper spring contact 106, as shown in FIG. 10. In this state, the solenoid switch is deenergized, opening the normally open contact 100 and closing the normally closed contact 102. The opening of the normally open contact 100 terminates electrical power to the motor 38, causing the rotation of the cam gear 70 to stop with the stud 74 in position "B" and the stud 76 in position "C". The closing of the normally closed contact 102 shorts out the motor 38. This dynamically brakes the motor to keep the cam gear 70 from coasting beyond the desired position.

Figure 11:
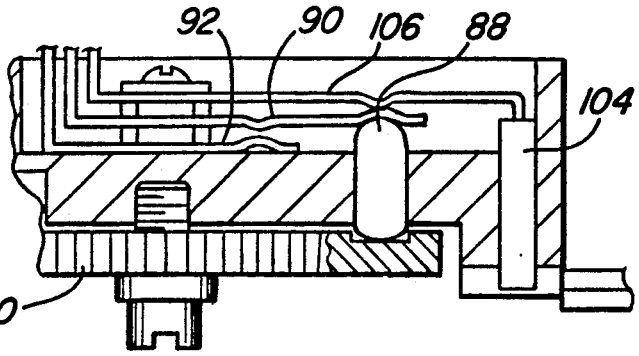
Figure 12:
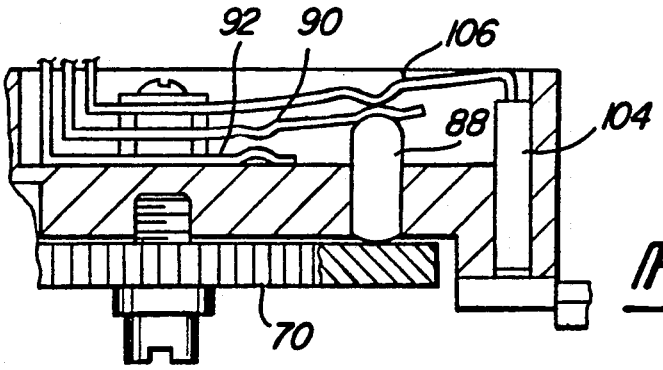

The lock mechanism will remain in this state until an attempt is made to close the rear deck lid. When the rear deck lid is closed sufficiently to displace the latch member 14 and the bypass cam 16 from under the post 104, the post 104 will descend under the bias of the upper spring contact 106, and the upper spring contact 106 will descend and make electrical contact with the center spring contact 90, as shown in FIG. 11. Electrical contact of the upper spring contact 106 with the center spring contact 90 will energize the relay switch 98 to again provide electrical power to the motor 38 and rotate the stud 76 from position "C" to position "A", as shown in FIG. 3. During this rotation interval the stud 76 will engage the edge of the bypass cam 16 and rotate it in a clockwise direction. The bypass cam 16 will engage the latch member's raised dog 24 and rotate the latch member 14 along with the bypass cam 16 towards the latched position. At the position "D" the stud 76 will have rotated the bypass cam 16 and latch member 14 a distance sufficient to permit the dog 42 to engage the dog catch 44, locking the latch member 14 in the latched position. As the cam gear 70 is being rotated, the cam follower 88 will rise out of the cam groove 78 or 80, raising both spring contacts 92 and 106 to their maximum heights, as shown in FIG. 12. The upper spring contact 106 will elevate the post 104 to a height sufficient to permit the post bar 108 to be displaced under the post 104 by the spring 110, thereby holding the post 104 in its elevated position. When the stud 76 reaches position "A", the cam follower 88 will fall in the leading section 84 of the next cam groove, returning the switch mechanism 40 to the state shown in FIG. 10, which is the latched state of the lock mechanism.

If the latch member 14 is released manually rotating the key actuated cam 30 by means of the key lock, the bypass cam 16 will displace the post bar 108 such that when the rear deck lid is closed sufficiently to displace the bypass cam 16 from under the post 104, the post 104 will descend permitting the upper spring contact 106 to make electrical contact with the center contact spring 90 and energizing the relay switch 98 to energize the motor 38 to lock the latch member 14, as previously described. If the rear deck lid is forceably closed down hard enough to lock the latch member 14 in the dog 42, the post 104 will descend, energizing the motor, which will continue to run until one of the studs 74 or 76 assumes position "A", as shown in FIG. 3.

If the latch member 14 is released from the dog 42 but the rear deck lid does not open due to an accumulated weight, such as heavy snow, the motor will drive the cam gear 70 until one of the studs 74 or 76 reaches position "A" and then will stop. The bypass cam 16 will not have moved far enough to displace the post bar 108; therefore, the upper spring contact 106 remains separated from the center spring contact 90 by the cam follower. To actuate the lock mechanism, the rear deck lid must be lifted a distance sufficient to cause the bypass cam 16 to displace the post bar 108. This prevents continuous recycling of the lock mechanism when the rear deck lid does not open after the latch member 14 is released.

The function of the bypass cam 16 will be explained with reference to FIGS. 3, 13, 14 and 15. The bypass cam 16 is connected to the latch member 14 by means of the raised dog 24 and the tab 50, so that the two will pivot together about the first pivot pin 18 as shown in FIGS. 3 and 13. The first coil spring 46 produces a force biasing the bypass cam 16 towards the latch member 14 so that the raised dog 24 engages the edge of the bypass cam 16, as shown in FIG. 13.

As illustrated in FIG. 3, if there is an electrical failure or a failure of the electrical lock actuator 36 which results in the cam gear 70 stopping with one of the studs 74 or 76 in the position designated "D", or any other nearby position, the stud will prohibit the bypass cam 16 from rotating to the unlatched position shown. Under this condition, the latch member 14 may still be released to the unlatched position by rotating the key actuated cam 30 to the position shown in FIG. 14. In this position, the ramp surface 34 provided on the key actuated cam 30 will slide under the bypass cam 16 and lift the bypass cam above the upper surface of the raised dog 24, as shown in FIG. 15. The rotation of the key actuated cam 30 will also pivot the lock member 26, releasing the latch member 14 from the dog 42. With the bypass cam 16 in the raised position, the latch member 14 is free to rotate to the unlatched position, independently of the bypass cam 16, as shown in FIG. 14. As previously indicated, the latch member 14 is independently biased by the third spring 52 to rotate the latch member 14 to the unlatched position. Therefore, when the rotation of the bypass cam 16 to the unlatched position is prohibited by one of the studs 74 or 76, the electrically actuated lock mechanism may still be manually unlocked using the conventional key lock.

Figure 16:
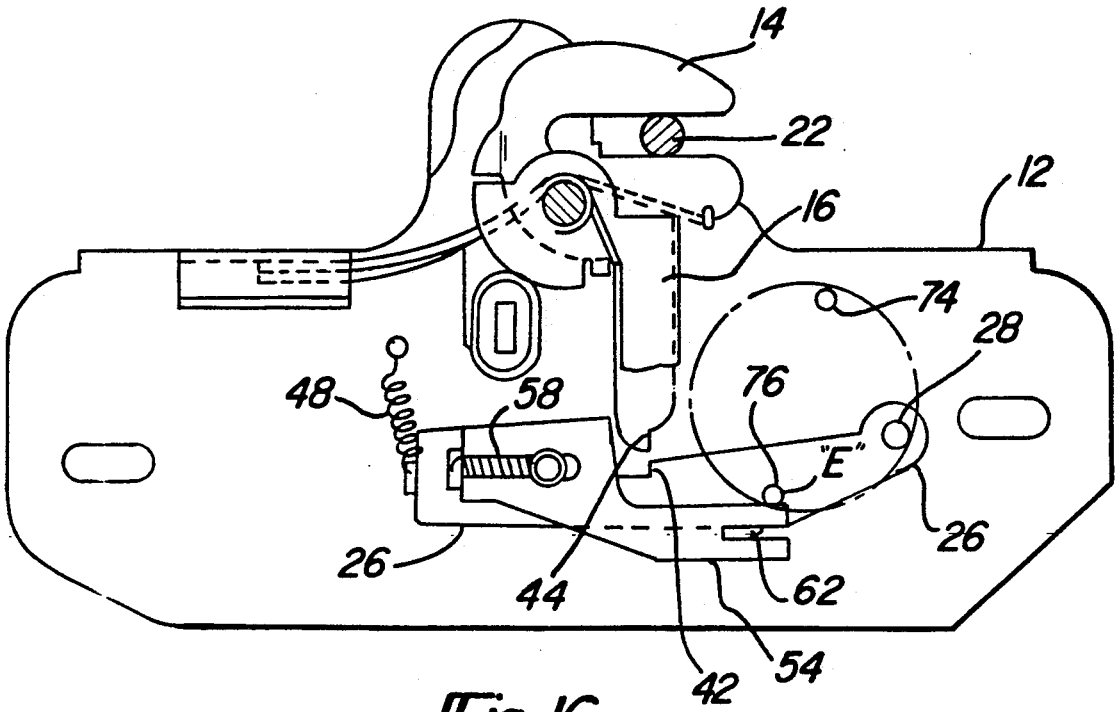
FIG. 16 is a plan view of the locking mechanism with the cam gear's stud stuck in a position holding the lock member disengaged from the latch member.
Figure 17:
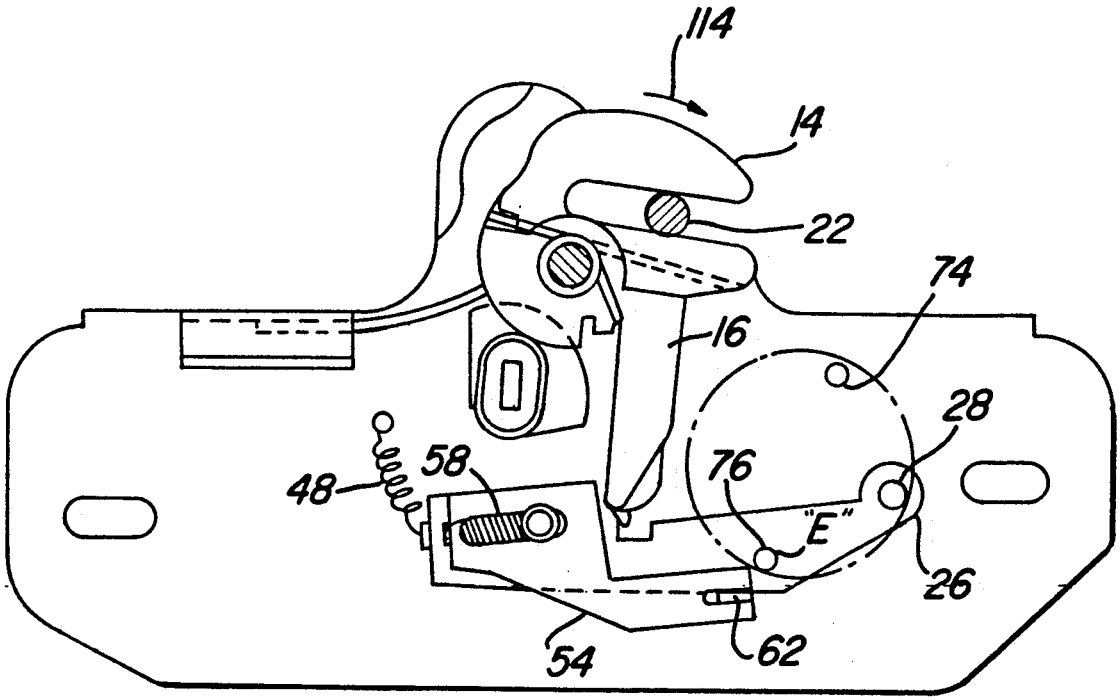
FIG. 17 is a plan view of the locking mechanism showing the displacement of the release plate by the bypass cam to release the locking member from the stuck stud.

The function of the release member 54 will now be explained with reference to FIGS. 16 and 17. In the event the electric motor 38 fails with one of the studs 74 or 76 in the position designated "E", as shown in FIG. 16, the stud, for example stud 76, is in engagement with the release member 54 and prevents the lock member 26 from pivoting back to the locked position as shown in FIG. 3. In this state, the dog catch 44 cannot engage the dog 42 and the deck lid cannot be locked. However, there is sufficient resiliency in the weather seals of the deck lid to permit the deck lid to be slightly depressed. Depression of the deck lid against the resiliency of the weather seals will cause the lock bar 22 to rotate the latch member 14 and the bypass cam 16 in a clockwise direction as indicated by arrow 114 in FIG. 17. This will cause the end of the bypass cam 16 to displace the release member 54 to the left a distance sufficient to disengage it from the stud 76, as shown.

When the release member 54 is disengaged from the stud, the lock member 26 and release plate may now be rotated by the second coil spring 48 to the position shown in FIG. 3. In this position, the dog catch 44 can engage the dog 42, locking the deck lid in the closed position. Thereafter the deck lid may be locked or unlocked with a key until the motor or cause of failure is repaired.

One advantage of the rear deck lid lock mechanism is that the locking of the rear deck lid in its closed position is assured, independent of the closing force. Another advantage of the rear deck lid lock mechanism is that the deck lid does not have to be slammed down to set the latch member in its locked position. Still another advantage of the rear deck lid lock mechanism is that the deck lid may be locked mechanically or electrically. A further advantage is that once the latch member is in the locked position, the electrical locking mechanism is disengaged from the latch member and all subsequent forces applied to the deck lid are sustained by the mechanical elements of the lock and not by any of the components in the electrical locking mechanism. Still another advantage of the lock mechanism is that it may be manually unlatched using the conventional key lock in the event of an electrical failure. A still further advantage is that the deck lid may still be locked in the closed position even if the electric motor fails in a position in which a stud on the cam gear is holding the lock member disengaged from the latch member.

It is intended that the invention not be limited to the specific embodiment illustrated in the drawings and discussed in the detailed description above. It is recognized that a person skilled in the art will be able to conceive different structural arrangements for performing equivalent function without departing from the spirit of the invention as described above and set forth in the appended claims.

What is claimed is:

1. A locking mechanism for entrapping a lock bar comprising:

a support frame;

a lock member pivotally attached to said support frame, said lock member having a lock dog and a guide tab;

a release member slidably attached to said lock member, said release member having a linear slot receiving said guide tab therein, said release member being displaceable along said linear slot between an engage and release position;

latch means having a latch member pivotally attached to said support frame and displaceable between an open and a locked position, said latch member having a dog catch engaging said lock dog to lock said latch member in said locked position, and a catch slot receiving said lock bar in said open position and entrapping said lock bar in said locked position, said latch means further being pivotable in response to forcibly rotating said latch member beyond said locked position to displace said release member to said release position;

first resilient means for producing a force biasing said latch member towards said open position;

second resilient means for producing a force biasing said lock member towards a locked position engaging said lock dog with said dog catch;

third resilient means for producing a force biasing said release member to said engage position;

a housing attached to said support frame;

a cam gear rotatably disposed in said housing, said cam gear having a predetermined cam surface;

an electric motor for rotating said cam gear;

at least one stud, protruding from said cam gear, engaging said latch means as said cam gear rotates through a first rotational interval to displace said latch member to said locked position, said at least one stud further engaging said release member when said release member is in said engage position to displace said lock member during a second rotational interval of said cam gear to disengage said lock dog from said dog catch, said at least one stud not engaging said release member when said release member is displaced by said latch means to said release position; and cam actuated switch means responsive to the displacement of said latch means from said open position towards said locked position for providing electrical power to said electric motor and responsive to a first contour of said cam surface for terminating said electrical power to said electric motor after said latch member is in said closed position, said cam actuated switch means further being responsive to an unlock signal for providing electrical power to said electric motor and responsive to a second contour of said cam surface for terminating said electrical power to said electric motor after said latch member is released from said locked position by the disengagement of said dog catch.

2. The locking mechanism of claim 1 wherein said cam actuated switch means comprises:

a first spring contact having a fixed end attached to said housing;

a second spring contact disposed adjacent to said first spring contact, said second contact having a fixed end attached to said housing and a free end, said second spring contact in its relaxed state making electrical contact with said first spring contact;

a third spring contact disposed adjacent to said second spring contact on the side opposite said first spring contact, said third spring contact having a fixed end attached to said housing and a free end, said third spring contact in its relaxed state making electrical contact with said second spring contact;

a cam follower slidably disposed in said housing between said cam surface of said cam gear and said free end of said second spring contact;

a post attached to said free end of said third spring contact slidably disposed in said housing above the location of said latch member in its open position; and a post lock pivotally attached to said housing, said post lock adapted to be biased to a first position locking said post in an elevated position and displaceable from said first position by said latch means in said open position allowing said post to descend.

3. The locking mechanism of claim 2 wherein said cam surface comprises the upper surface of said cam gear and at least one bi-level arcuate cam groove provided in the upper surface of said cam gear, said at least one bi-level cam groove having an intermediate level extending in the direction of said cam gear's rotation a first predetermined circumferential distance relative to said at least one stud and having a contiguous lower level extending a second predetermined circumferential distance in front of said intermediate level in the direction of said cam gear's rotation and wherein said cam follower disposed on said lower level of said bi-level cam groove allows said second spring contact to assume its rest position in which it is in electrical contact with said first spring contact, said cam follower disposed on said intermediate level of said bi-level cam groove raising said second spring contact a distance sufficient to break said electrical contact with said first spring contact, and said cam follower interposed said cam surface of said cam gear raises said second and third spring contacts and said post a distance sufficient for said biased post lock to be displaced under said post, locking said second and third spring contacts in said raised position.

4. The locking mechanism of claim 3 wherein said at least one stud comprises two studs diametrically opposed to each other on said predetermined surface of said cam gear and wherein said at least one bi-level cam groove comprises two bi-level cam grooves diametrically opposed to each other.

5. The locking mechanism of claim 1 further comprising a key actuated cam rotatably attached to said support frame adjacent to said lock member, said key actuated cam being operative to pivotally displace said lock member a distance sufficient to disengage said lock dog from said dog catch in response to being rotated by a key operated lock.

6. The locking mechanism of claim 4 further comprising a key actuated cam rotatably attached to said support frame adjacent to said lock member, said key actuated cam being operative to pivotally displace said lock member a distance sufficient to disengage said lock dog from said dog catch in response to being rotated by a key operated lock.

7. The locking mechanism of claim 5 wherein said latch means comprises a bypass cam pivotally attached to said support frame juxtaposed to said latch member and means for releasably linking said bypass cam with said latch member so that they can pivot together, and wherein said at least one stud engages said bypass cam to displace said latch member to said locked position, and wherein said key actuated cam comprises means for releasing said latch member from said bypass cam.

8. The locking mechanism of claim 7 wherein said means for releasably linking said bypass cam to said latch member comprises a raised dog provided on said latch member engaging one edge of said bypass cam to prohibit independent rotation of said latch member towards said unlocked position and a tab provided on said bypass cam engaging an edge of said latch member to prohibit independent rotation of said bypass cam towards said open position and wherein said means for releasing said latch member from said bypass cam is a ramp surface provided on said key actuated cam which displaces said bypass cam from said latch member in response to the rotation of said key actuated cam, said ramp surface displacing said bypass cam a distance sufficient to disengage said bypass cam from said raised dog permitting said latch member to be displaced to said open position independent of the position of said bypass cam.

9. A locking mechanism for engaging a lock bar to secure a rear deck lid of an automotive vehicle having a key operated lock, said locking mechanism comprising:

a support bracket;

a latch member pivotally attached to said support bracket, said latch member having a catch slot engaging said lock bar to lock said rear deck lid when said latch member is in a locked position;

a bypass cam pivotally attached to said support bracket adjacent to said latch member;

means for releasably attaching said bypass cam to said latch member such that they pivot together as a single unit;

lock means pivotally attached to said support bracket, said lock means having a first position locking said latch member in said locked position and displaceable to a second position releasing said latch member;

a release member slidably attached to said lock means, said release member being displaceable from a normal position to a release position by said bypass cam in response to forcibly closing said rear deck lid to displace said latch member beyond said locked position;

means for biasing said latch member towards an open position;

means for biasing said lock means towards said first position;

means for independently biasing said bypass cam to pivot in the same direction as said latch member; and an electrical actuator responsive to the engagement of said lock bar in said catch slot to pivotally displace said bypass cam and said latch member to said locked position and responsive to an unlock signal to engage said release member when said release member is in said normal position, the engagement of said release member displacing said lock means to said second position releasing said latch member from its locked position, wherein the displacement of said release member to said release position disengages said release member from said electrical actuator.

10. The locking mechanism of claim 9 wherein said electrical actuator comprises:

a cam gear having a multilevel cam surface;

an electric motor for rotating said cam gear;

at least one stud protruding from said cam gear operative to displace said bypass cam and said latch member to said locked position during a first rotational interval of said cam gear, said at least one stud further being operative to engage said release member and displace said release member and said lock means to said second position during a second rotational interval of said cam gear; and switch means responsive to the displacement of said latch member towards said locked position by the closing of said rear deck lid for providing electrical power to said motor to rotate said cam gear through said first rotational interval in which said at least one stud displaces said latch member to said locked position and responsive to a first contour of said multilevel cam surface to terminate the electrical power to said motor to terminate said first rotational interval, and responsive to an unlock signal to provide electrical power to said motor to rotate said cam gear through said second rotational interval in which said at least one stud temporarily displaces said lock member to said second position, said switch means further being responsive to a second contour of said multilevel cam surface to terminate the electrical power to said motor after said lock means has returned to said first position terminating said second rotational interval.

11. The locking mechanism of claim 9 further comprising a key actuated cam rotatably attached to said support bracket adjacent to said lock means, said key actuated cam being operative to displace said lock means to said second position in response to being rotated by said key operated lock.

12. A locking mechanism for engaging a lock bar to secure a rear deck lid of an automotive vehicle having a key operated lock, said locking mechanism comprising:

a support bracket;

a latch member pivotally attached to said support bracket, said latch member having a catch slot engageable with said lock bar in an open position and entrapping said lock bar to lock said rear deck lid in a closed position;

a bypass cam pivotally attached to said support bracket adjacent to said latch member;

means for releasably connecting said bypass cam with said latch member, forcing them to pivot as a single unit;

a lock member pivotally attached to said support bracket, said lock member having a first position locking said latch member in said closed position and displaceable to a second position releasing said latch member from said closed position;

a release member slidably connected to said lock member, said release member being resiliently biased to a normal position and displaceable to a release position by said bypass cam when said rear deck lid is forcibly closed pivoting said latch member beyond its closed position;

means for biasing said latch member and said bypass cam towards said open position;

means for biasing said lock member towards said first position;

an electric actuator responsive to the displacement of said latch member from its open position by said lock bar during the manual closing of said rear deck lid to pivotally displace said bypass cam and said latch member to said closed position and responsive to an unlock signal for engaging said release member to displace said lock member to said second position wherein the displacement of said release member to said release position disengages said release member from said electric actuator; and a key actuated cam for displacing said lock member to said second position in response to being rotated by said key operated lock, said key actuated cam having means for releasing said latch member from said bypass cam permitting said latch member to pivot to said first position independent of the position of said bypass cam.

13. The locking mechanism of claim 12 wherein said lock member has a guide tab protruding from the side facing said release member and wherein said release member has a first slot in which said guide tab is received.

14. The locking mechanism of claim 13 further comprising a spring member connected between said lock member and said release member to bias said guide tab to one end of said first slot.

15. The locking mechanism of claim 13 wherein said release member has a second slot parallel to said first slot and a spring tab, and wherein said lock member has a spring post which extends through said second slot and wherein said spring member is connected between said spring tab and said spring post.

16. An improved locking mechanism for engaging a lock bar provided in an automotive vehicle to secure a rear deck lid, said automotive vehicle having a key operated lock, said locking mechanism being of the type having a support frame, a latch member engagable with said lock bar, said latch member pivotably displaceable between an open and locked position, a lock member for locking said latch member in said locked position, means for biasing said latch member towards said open position and for biasing said lock member to engage said latch member, an electric actuator for pivotably displacing said latch member to said locked position during a first rotational interval and for displacing said lock member during a second rotational interval to disengage said latch member from said locked position, and a key actuated cam for displacing said lock member to disengage said latch member in response to the turning of said key operated lock, the improvement comprising:

a release member slidably attached to said lock member, said release member being resiliently biased to a first position in which it is engageable by said electric actuator during said second rotational interval to pivotably displace said lock member, disengaging said latch member from said locked position and displaceable by said latch member being pivoted beyond said locked position in response to said deck lid being forceably closed to a second position in which said release member is not engagable by said electric actuator during said second rotational interval.

17. The improvement of claim 16 wherein said lock member has a guide tab protruding from the surface thereof and wherein said release member has a first slot receiving said guide tab to permit a linear displacement of said release member relative to said lock member in a direction parallel to said first slot.

18. The improvement of claim 17 wherein said lock member has a guide post extending from its surface at a location displaced from said guide tab and wherein said release member has a second slot parallel to said first slot, said guide post being received in said second slot.

19. The improvement of claim 18 further comprising a spring connected between said spring post and said release member to produce a force biasing said release member towards said first position along the length of said first and second slots.

20. An improved locking mechanism for engaging a lock bar provided in an automotive vehicle to secure a rear deck lid, said automotive vehicle having a key operated lock, said locking mechanism being of the type having a support frame, latch member engageable with said lock bar, said latch member pivotably displaceable between an open and locked position, a lock member for locking said latch member in said locked position, means for biasing said latch member towards said open position and for biasing said lock member to engage said latch member, an electric actuator for pivotably displacing said latch member to said locked position during a first rotational interval and for displacing said lock member during a second rotational interval to disengage said latch member from said locked position, and key actuated cam for displacing said lock member to disengage said latch member in response to the turning of said key operated lock, the improvement comprising:

means for disengaging said lock member from said electric actuator in response to pivoting said latch member beyond said locked position by forcibly closing said rear deck lid.

* * * * *

UNITED STATES PATENT AND TRADEMARK OFFICE

CERTIFICATE OF CORRECTION

PATENT NO. : 5,007,261

DATED : April 16, 1991

INVENTOR(S) : Norman G. Quantz

It is certified that error appears in the above-identified patent and that said Letters Patent is hereby corrected as shown below:

Column 1, line 47, after "having" insert ---- a ----.

Column 3, line 55, before "vehicle" insert ---- a ----.

Column 8, line 25, delete "function" and insert ---- functions ----.

In the Claims

Column 9, line 25, after "second" insert ---- spring ----.

Column 14, line 12, after "frame," insert ---- a ----.

Column 14, line 22, after "and" insert ---- a ----.

Signed and Sealed this

First Day of September, 1992

*Attest:*

*Attesting Officer*

DOUGLAS B. COMER

*Acting Commissioner of Patents and Trademarks*